US008943732B2

(12) United States Patent
Schmidt et al.

(10) Patent No.: US 8,943,732 B2
(45) Date of Patent: Feb. 3, 2015

(54) TELESCOPIC SIGHT WITH ELECTRONIC MODULE, ELECTRONIC MODULE FOR A TELESCOPIC SIGHT AND PROGRAMMING ADAPTER FOR ELECTRONIC MODULE

(71) Applicant: Schmidt & Bender GmbH Co. KG, Biebertal (DE)

(72) Inventors: Werner Schmidt, Wettenberg/Krofdorf (DE); Manuel Schmidt, Wetzlar/Steindorf (DE)

(73) Assignee: Schmidt & Bender GmbH Co. KG, Biebertal (DE)

( * ) Notice: Subject to any disclaimer, the term of this patent is extended or adjusted under 35 U.S.C. 154(b) by 0 days.

(21) Appl. No.: 14/096,276

(22) Filed: Dec. 4, 2013

(65) Prior Publication Data

US 2014/0157647 A1 Jun. 12, 2014

(30) Foreign Application Priority Data

Dec. 11, 2012 (DE) ..... 10 2012 112 122

(51) Int. Cl.
*F41G 1/38* (2006.01)
*F41G 1/34* (2006.01)

(52) U.S. Cl.
CPC . *F41G 1/38* (2013.01); *F41G 1/345* (2013.01)
USPC ..... 42/123; 42/131; 356/247; 359/399; 359/428

(58) Field of Classification Search
CPC ..... F41G 1/38; F41G 11/00; G02B 23/16
USPC ..... 42/123, 131; 356/247; 359/399, 428
See application file for complete search history.

(56) References Cited

U.S. PATENT DOCUMENTS

| | | | | |
|---|---|---|---|---|
| 6,721,095 | B2 * | 4/2004 | Huber | 359/427 |
| 7,401,433 | B2 * | 7/2008 | Schiller et al. | 42/123 |
| 7,621,708 | B2 * | 11/2009 | Hampel et al. | 412/11 |
| 2010/0157292 | A1 | 6/2010 | Tsai et al. | |

FOREIGN PATENT DOCUMENTS

| | | |
|---|---|---|
| DE | 29 904 303 | 10/1999 |
| DE | 101 36 278 | 2/2003 |
| DE | 103 61 909 | 7/2005 |
| EP | 1 643 205 | 4/2006 |
| WO | 2011/140466 | 11/2011 |

* cited by examiner

*Primary Examiner* — J. Woodrow Eldred
(74) *Attorney, Agent, or Firm* — Clark & Brody

(57) ABSTRACT

The invention relates to a telescopic sight for a firearm which has a telescope body (2) with an eyepiece (3) and an objective (4) and an illuminating device for an illuminated graticule, wherein the illuminating device has a control electronics unit (22) and an energy store (23). Further, the invention relates to an illuminating module (7) for a telescopic sight of this kind and a programming adapter (30) for an illuminating module of this kind.

Figure 1:
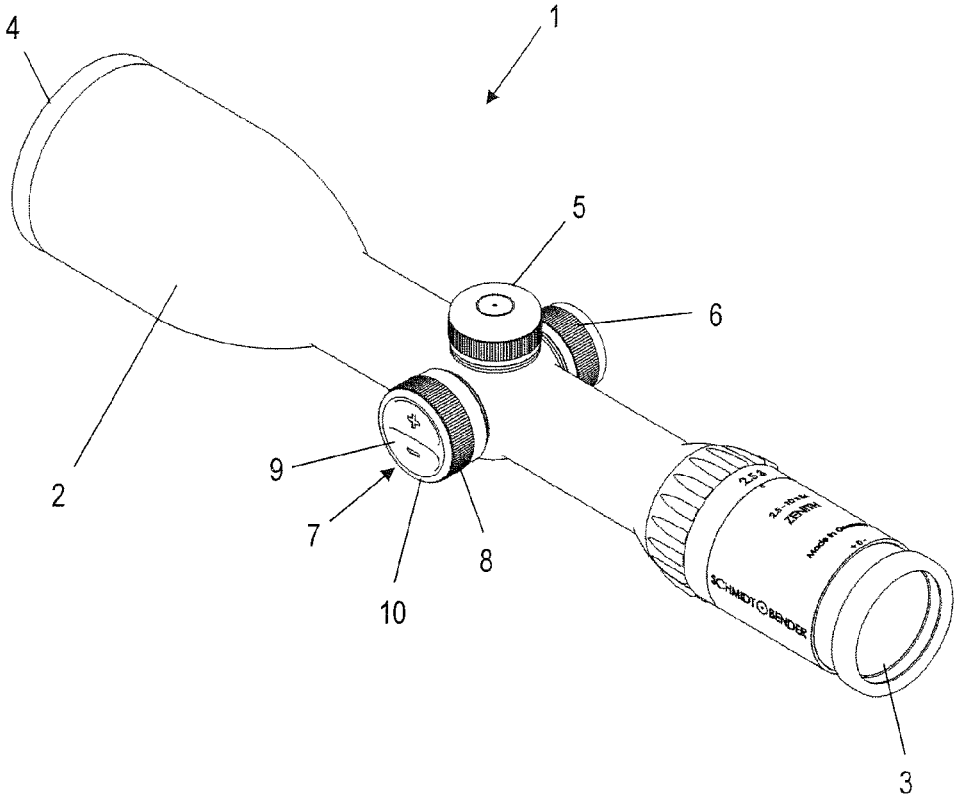

In order to enable an individual adjustment of the illumination characteristic, the control electronics unit (22) is arranged in a housing (10) which can be releasably accommodated in a saddle (8) on an outside of the telescopic sight (1), wherein the housing (10) with the control electronics unit (22) forms an independently manageable illuminating module (7) which can be fitted into a programming adapter (30).

16 Claims, 3 Drawing Sheets

TELESCOPIC SIGHT WITH ELECTRONIC MODULE, ELECTRONIC MODULE FOR A TELESCOPIC SIGHT AND PROGRAMMING ADAPTER FOR ELECTRONIC MODULE

The invention relates to a telescopic sight for a firearm according to the pre-characterizing clause of claim 1. Further, the invention relates to an illuminating module for a telescopic sight of this kind and a programming adapter for an illuminating module of this kind.

The telescopic sight has a telescope body with an eyepiece and an objective and an illuminating device for an illuminated graticule. Here, the illuminating device comprises a control electronics unit and an energy store.

Telescopic sights are generally required with firearms for the exact alignment of the firearm with a distant target. The target, which is received as an image by the objective, is then observed via an eyepiece. At the same time, depending on the configuration, different lens arrangements can be arranged within the telescope body, for example an inverting lens or an inverting lens system for correct orientation of the image, variable magnification and similar.

An illuminated graticule, such as an illuminated sight for example, is provided in the telescopic sight for better acquisition of the target. The graticule can take different forms. For example, the graticule is designed as a cross or a light spot. By providing an illuminating device for the graticule, the graticule can also easily be seen under unfavorable optical conditions. However, the brightness of the illuminating device needs to be adapted to the ambient brightness and/or the target background in order, on the one hand, to prevent dazzling of the marksman in poor lighting conditions, and, on the other, to ensure sufficient contrast of the graticule even in bright lighting conditions.

It is therefore known to adjust the illumination level of the illuminating device by means of a control electronics unit. In doing so, the illumination level is usually selected from an illumination range predefined by the manufacturer depending on the particular application. At the same time, there are also solutions with which the brightness of the environment is measured with the help of an ambient sensor and the illumination level of the illuminating device is adjusted as a function thereof. However, as the perception characteristics of the eye differ from person to person and as the possible applications are also often very different, there is a basic desire to individualize the illuminating device.

Usually, the control electronics, which as a rule are mounted on a board and are fitted in the telescopic sight, are changed for this purpose. To do this, it is necessary to remove the telescopic sight from the weapon, wherein the telescopic sight or at least the illuminating device with the control electronics must be sent to the manufacturer of the telescopic sight to enable him to change the control electronics. After fitting the telescopic sight to the weapon, the weapon must then be re-zeroed.

Adjusting the illuminating device for individual preferences or applications is therefore associated with a great deal of effort.

The invention is now based on the object of removing the disadvantages of the prior art and specifying a possibility by means of which a characteristic of the illuminating device, such as the illumination level, can be individualized with little effort. At the same time, the solution should require little installation space and be able to be preassembled to the greatest possible extent.

This object is achieved by a telescopic sight with the characteristics of claim 1, by an illuminating module with the characteristics of claim 9, and by a programming adapter with the characteristics of claim 14.

The main features of the invention are specified in the characterizing part of claims 1, 9 and 14. Embodiments are the subject matter of dependent claims 2 to 8, 10 to 13, 15 and 16.

According to the invention, it is therefore provided that the telescopic sight has a control electronics unit which is arranged in a housing which can be releasably accommodated in a saddle on an outside of the telescopic sight.

The control electronics with the housing therefore forms an illuminating module which can be relatively easily changed or modified in order to adapt the illuminating device to individual preferences and conditions of use. In doing so, for example, it is possible to adjust the illumination level, a color, brightness and/or number of illumination stages as well as the ratio of the illumination level to an ambient brightness and similar. It is not necessary to change a component, such as a board for example, which is arranged within the telescopic sight. Rather, the control electronics with the housing can be released from the telescopic sight and changed or modified without the telescopic sight having to be removed from the weapon or the illuminating device as such. Accordingly, re-zeroing is therefore also unnecessary.

By using a programmable control electronics unit, which if necessary includes a storage element, adjustment can be carried out relatively easily, for example by means of a PC, in a workshop, but, if necessary, also directly by the customer or marksman. The parameters of the illuminating device can then be stored in the storage element, for example, and overwritten. Retrospective and/or repeated adjustment of the illuminating device can therefore be carried out very easily without having to change components.

In a preferred development, the housing has electronic contact surfaces, wherein contact elements corresponding thereto are arranged in the saddle. By placing the housing in the saddle, the electronic contact surfaces come into contact with the corresponding contact elements so that they are in data and current-transmitting connection with one another. In doing so, the contact surfaces can be applied flat to a part of the housing, but can also be formed on spring terminals or similar. The contact elements can also be formed as spring elements, for example, or as electrically conducting surfaces. In any case, the connection between the control electronics and the illuminating device is ensured automatically when the housing with the control electronics is placed in the saddle. No additional intervention is necessary for this purpose.

Preferably, the housing can be screwed to the saddle, wherein in particular the housing has an external thread and the saddle an internal thread. Screwing provides a relatively simple way of producing a safe, releasable connection between the housing and the saddle. As a result of the combination of an external thread on the housing and an internal thread on the saddle, the housing can at least partially be accommodated in the saddle, thus producing a stable mounting with which the housing projects only slightly, if at all, outwards over the saddle and is therefore protected against environmental influences.

A particularly simple embodiment results from the housing being in the form of a circular cylinder and having an inner and an outer face side. The electronic contact surfaces are then preferably arranged on the inner face side. The designation inner and outer refers here to the fitted state of the housing, that is to say when the control electronics with the housing are accommodated in the saddle on the outside of the telescopic sight. The outer face side can feature a metal or an elastomer, for example, and is intended to securely seal the housing with respect to the outside. At the same time, the face side can be designed, for example, in the form of a cover which is connected to the housing which has a tubular wall, for example. By providing the electronic contact surfaces on the inner face side, they are accommodated inside the saddle when the housing is fitted and therefore protected against external influences. This keeps the risk of faults small.

Control elements for affecting the control electronics, for example for changing the brightness of the illumination manually, can be formed on the outer face side. The control elements can be marked, e.g. by embossments or colored marks on the face side. The corresponding areas of the control electronics, which can be operated through the face side for example, are then covered by the face side and are accordingly accommodated in the housing in a protected manner. For this purpose, the face side must have sufficient elasticity to enable force to be transmitted from the outside to the inside. This elasticity can be achieved both by metal and by an elastomer. Alternatively, the control elements can also be designed as touch-sensitive areas on the outer face side.

In a particularly preferred embodiment, the saddle has a sleeve-shaped wall which is rotatably and axially immovably mounted on the telescopic sight, wherein the internal thread is arranged in the wall, and the housing, at least for the most part, can be screwed into the wall. At the same time, the wall has an annular cross section. The housing is then fitted by placing the housing on the open side of the saddle so that the external thread engages with the internal thread of the wall. By rotating the wall, the housing is then moved axially with respect to the axis of rotation towards the telescopic sight and drawn into the saddle so that the housing can be for the most part or completely accommodated within the saddle. In doing so, the contact surfaces are pressed axially against the contact elements, thus ensuring a reliable connection.

At the same time, it is particularly preferred that the housing is guided in a fixed rotational relationship with respect to the telescopic sight. This enables a consistent alignment of the face side and therefore a consistent alignment of the control elements. Further, the fitting of the housing is simplified, as it does not have to be manually secured against rotation, and such securing is carried out by means of an interlocking guide for example. This simplifies the fitting and removal of the housing and the illuminating module.

Preferably, the energy store is in the form of a battery which is arranged in a battery cage of the housing, which in particular is accessible from the inner face side. A battery constitutes a very cost-effective electrical energy store. The use of a battery cage and the arrangement of the battery within the housing enable the battery to be changed easily without the need to further dismantle the telescopic sight. Providing access from the inner face side results in additional safeguarding of the battery, as it can then only be removed from the housing when the illuminating module has been removed from the saddle.

In order to reduce the risk of damage and functional faults due to environmental influences, the housing can advantageously be connected to the saddle in a watertight and dust-tight manner, wherein in particular at least one sealing element is arranged between housing and saddle. A sealing element of this kind can be in the form of a sealing ring, for example, which produces a radial seal between the housing and the wall of the saddle. By this means, a reliable seal can be ensured.

The saddle itself is inseparably connected to the telescopic sight and can therefore be sealed with respect to the telescopic sight relatively easily, for example by likewise providing additional sealing elements. In doing so, the saddle can be arranged directly on the telescope body and also in other suitable positions on the telescopic sight.

According to the invention, the object is achieved by an illuminating module in that it has a housing in which a programmable control electronics unit for an illuminating device of the telescopic sight is arranged.

The control electronics are therefore not, as previously, permanently connected to the illuminating device accommodated in the telescopic sight, but in an illuminating module which can be detached from the telescopic sight. As a result, the control electronics can be changed or adjusted separately from the telescopic sight without the need for further dismantling the telescopic sight. When the adjustment is complete, the illuminating module is placed in an appropriate saddle on the telescopic sight. The telescopic sight is then immediately ready for use once more.

Here, the control electronics unit preferably has a storage element in which the parameters of the illuminating device which are to be changed can be stored. By way of example, the parameters include the illumination level, a color, the brightness and/or a number of intensity stages. It is also conceivable to change the ratio of the illumination level to the ambient brightness for example. All in all, the illuminating device can be matched to individual preferences and special fields of use with very little effort.

In an advantageous embodiment, the housing is in the form of a circular cylinder and in particular has electrical contact surfaces on an inner face side. Control elements for affecting the control electronics can be formed on an outer face side. Areas which form the control elements are marked by embossments or in color for example. At the same time, the outer face side can feature a metal or an elastomer. The descriptions inner and outer refer to an assembled state of the illuminating module. A circular cylindrical embodiment of the housing enables a very robust design and accurate manufacturing. This enables an accurate fit to be achieved between a saddle, which is formed on the telescope body of the telescopic sight for example, and the housing of the illuminating module. By providing the electrical contact surfaces on an inner face side of the housing they are accommodated in a protected manner when the illuminating module is arranged on the telescopic sight, thus minimizing the risk of faults due to environmental influences. Providing an outer face side made of elastomer, which can be connected to the remaining housing in the form of a cover for example, results in a surface which is insusceptible to shock. In doing so, buttons for controlling the illuminating module can be actuated through the correspondingly elastic face side. This is possible without problems both with a metallic face side and with a face side made of an elastomer.

In a preferred development, the housing has an external thread. This is very easily possible particularly when the housing is embodied as a circular cylindrical body, and enables a releasable connection with the telescopic sight to be produced without major effort.

Preferably, the housing encompasses a battery cage for an electrical energy store which in particular is accessible from the inner face side of the housing. An example of an energy store of this kind is a battery or an accumulator. A secure retention for this is provided in the battery cage. At the same time, loss of the energy store when the illuminating module is fitted is virtually excluded if the battery cage is only accessible from the inner face side of the housing, as this is then covered by the telescopic sight.

Preferably, the control electronics are arranged on at least one board which in particular rests against the outer face side on the inside. As a result of the control electronics resting against an inner side of the outer face side, a seating which is free from play is obtained, wherein the control electronics are protected by the face side. At the same time, arranging the control electronics on a board constitutes a cost-effective manufacturing method and enables a relatively simple repair by replacement of the board in the event of damage to the control electronics.

The object is achieved by a programming adapter in that it has an interface for a computer and a base with a mounting for the illuminating module, wherein the mounting has contact elements, particularly on the bottom thereof, for producing a data-transmitting connection to the illuminating module. In doing so, the contact elements are formed in such a way that they correspond to the contact surfaces of the illuminating module, that is to say they come into contact therewith when the illuminating module is placed in the mounting. A connection between the control electronics of the illuminating module and a computer can be produced relatively easily with the help of a programming adapter of this kind. The computer can be a commercially available PC or Mac for example. With the help of appropriate software, it is then possible to adjust the illuminating module without any problems and therefore to individually adjust parameters of the illuminating device of the telescopic sight, such as for example the illumination level and similar.

Preferably, the mounting of the programming adapter has a sleeve-shaped wall in which the illuminating module can be accommodated. This results in a secure retention of the illuminating module on the programming adapter, thus enabling reliable data transmission to be also guaranteed.

In a preferred embodiment, the sleeve-shaped wall has an internal thread and is rotatably mounted with respect to the base of the programming adapter, wherein the contact elements are arranged on the base, and the illuminating module can be accommodated in the mounting in a fixed rotational relationship with respect to the base. The connection between the programming adapter and the illuminating module is then made by rotating the wall of the mounting. The contact surfaces of the illuminating module and the contact elements of the base are then moved axially towards one another and finally pressed against one another. There is no sliding of the contact elements against the contact surfaces. No wear of the contact surfaces or the contact elements is therefore to be expected, even when the illuminating module is frequently placed in and removed from the programming adapter.

The advantages described in conjunction with the telescopic sight, the illuminating module and the programming adapter are mutually conferrable in a similar way.

Figure 2:
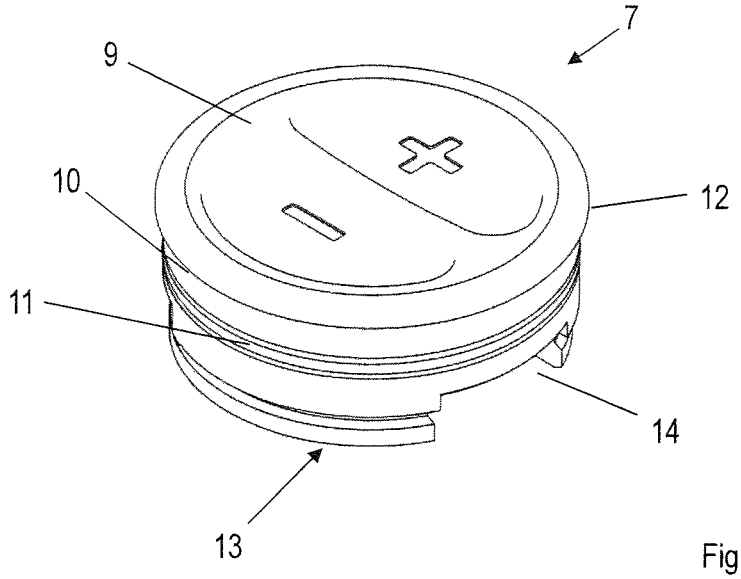
Figure 3:
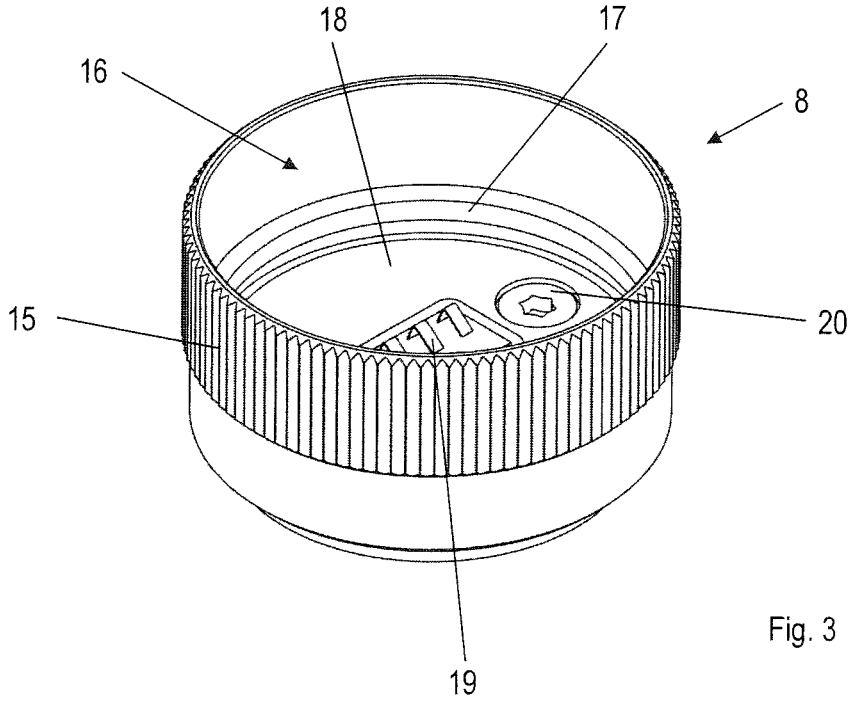
Figure 4:
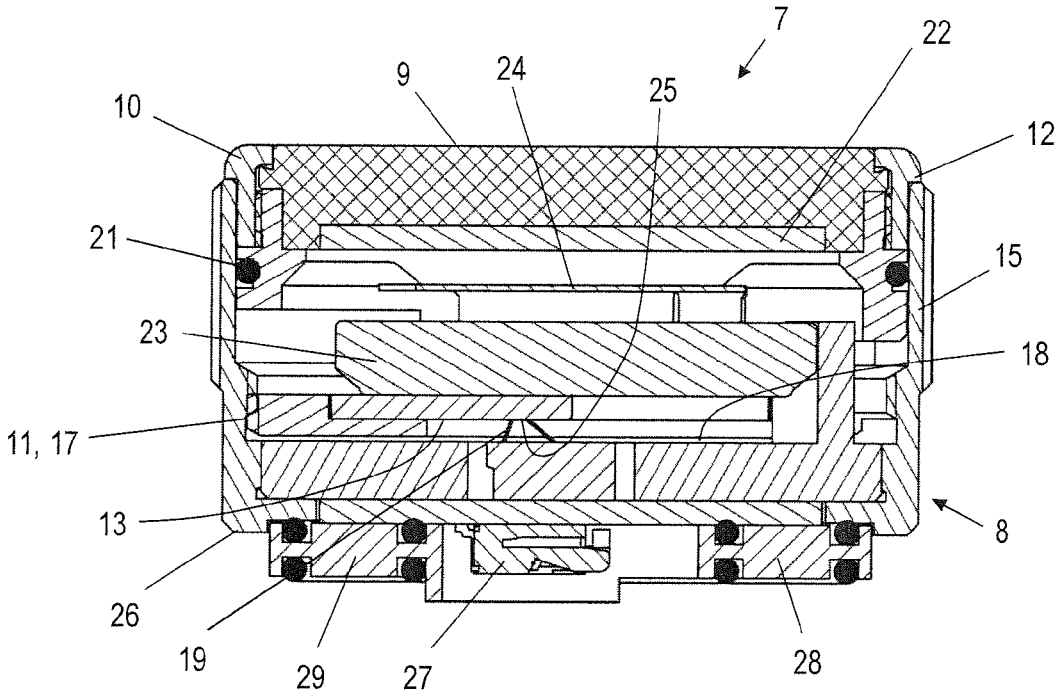
Figure 5:
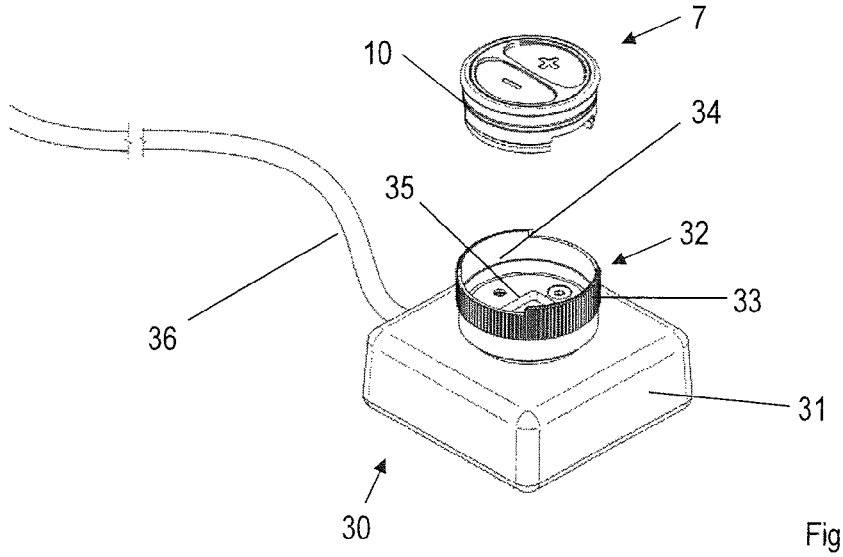

Further characteristics, details and advantages of the invention can be seen from the wording of the claims and from the following description of exemplary embodiments with reference to the drawings. In the drawings:

FIG. 1: shows a telescopic sight with an illuminating module in a spatial representation, FIG. 2: shows an illuminating module in a spatial representation, FIG. 3: shows a saddle for accommodating the illuminating module in a spatial representation, FIG. 4: shows the illuminating module accommodated in the saddle in a cross-sectional representation, and FIG. 5: shows an illuminating module with a programming adapter.

FIG. 1 shows a telescopic sight 1 in a spatial representation. The telescopic sight 1 has a telescope body 2 which has an eyepiece 3 at one end and an objective 4 at the opposite end. An adjuster 5, 6 for a graticule is arranged approximately centrally on the telescope body 2, wherein the top adjuster 5 is used for a vertical adjustment of the graticule and the side adjuster 6 for a horizontal adjustment.

In this exemplary embodiment, an illuminating module 7, which is accommodated in a saddle 8, is arranged on the side of the telescope body 2 diametrically opposite the horizontal adjuster 6. The saddle 8 is securely connected to the telescopic sight 1. An outer face side 9 of the housing 10 of the illuminating module 7 is formed elastically and has an embossment "Plus" and "Minus". By pressing these embossed points, which form control elements, a control electronics unit arranged in the housing 10 is activated and a brightness of an illuminating device of the telescopic sight 1, which is provided for illuminating a graticule, is manually controlled. As an example, the active illumination stage can be selected by this means.

The illuminating module 7 is shown as an individual part in FIG. 2. The housing 10 of the illuminating module 7 is in the form of a circular cylinder and has an external thread 11. Here, a collar 12, which projects radially outwards and defines a maximum screw-in depth for the illuminating module 7, is formed in the region of the outer face side 9.

A cutout 14, which prevents rotation when the housing 10 is placed in the saddle 8, is formed on an inner face side 13 axially opposite the outer face side 9.

The saddle 8 is shown as an individual part in a spatial representation in FIG. 3. The saddle 8 has a sleeve-shaped wall 15 which encompasses a mounting space 16 for the illuminating module 7 in the form of a ring. An internal thread 17, which corresponds to the external thread 11 of the illuminating module 7, is formed internally on the wall 15.

Contact elements 19, which are shaped in the form of spring sheets, are arranged on a bottom 18 of the saddle 8. Contact surfaces of the illuminating module come into contact with these contact elements 19 when the illuminating module is placed in the saddle 8. In doing so, an electrically conducting and data-transmitting connection is made via the contact elements 19 and the corresponding contact surfaces of the illuminating module 7.

Fixing screws 20, with which the saddle 8 can additionally be fixed to the telescopic sight 12 if necessary in order to obtain as secure a seating as possible, are arranged in the bottom 18 of the saddle 8.

A sectional view of the illuminating module 7 accommodated in the saddle 8 is shown in FIG. 4. For this purpose, the illuminating module 7 with its housing 10 has been screwed into the saddle 8. A sealing element 21 in the form of a sealing ring is arranged between the inside of the wall 15 and the housing 10 to provide a watertight and dust-tight seal between the housing 10 and the wall 15 of the saddle 8. Here, the sealing element 21 is accommodated in an annular groove, which is formed in the housing 10, and axially secured thereby.

The outer face side 9 is formed by an elastomer cover, against the inside of which rests a control electronics unit 22, which is designed in the form of a board. On the one hand, this provides a vibration-proof mounting of the control electronics 22, on the other however, it is also relatively easy to use the outer face side 9 as a pressure surface to transmit control commands to the control electronics 22, such as for example a dimming or brightening of an illumination level. For this purpose, the control electronics can have appropriate pressure-sensitive areas or buttons which rest against the face side.

Furthermore, a battery 23 is arranged in a battery cage 24 in the housing 10. Here, the battery 23 constitutes an electrical energy store and supplies the control electronics with the required electrical energy. At the same time, the whole illuminating device of the telescopic sight can also be supplied with the necessary electrical energy via the battery 23 if need be.

Contact elements 19 rest against contact surfaces 25 on the inner face side 13 of the housing 10. This results in the illuminating module 7 being conductively connected to the illuminating device of the telescopic sight via the saddle 8. An appropriate electrical plug-in connector element 27 is formed on an underside 26 of the saddle 8 for this purpose.

The saddle 8 is usually securely connected to the telescopic sight, for example to the telescope body 2. It is only necessary to remove the saddle 8 in exceptional cases. The saddle 8 is therefore connected by force and by interlocking to the telescopic sight 1 by means of appropriate interlocking connecting geometries 28, 29, which are provided with sealing elements. Gluing can also be used if necessary.

A programming adapter 30 for the illuminating module 7 is shown in a spatial representation in FIG. 5. The programming adapter 3 comprises a base 31, on which a mounting 32 with a sleeve-shaped wall 33 is arranged. Here, the wall 33 can be rotated with respect to the base 31 and has an internal thread 34 which corresponds to the external thread which is formed on the housing 10 of the illuminating module 7. In doing so, the illuminating module 7 can be inserted in the mounting 32 by rotating the wall 33. At the same time, the contact surfaces 25 of the illuminating module 7 come into contact with contact elements 35 which are arranged on the base 31 inside the mounting 32.

The programming adapter 30 has an interface 36 in the form of a connecting cable for connecting to a computer. A connection to a computer can be made in a relatively simple manner by this means.

The parameters of an illuminating device for an illuminated graticule can be individualized with very little effort by means of the telescopic sight according to the invention with a control electronics unit in the form of an illuminating module accommodated in a housing and by means of this illuminating module and the corresponding programming adapter. This results in simple fitting and exchangeability. Repair and adaptation to customer requirements are also possible with little effort. This enables the maximum possible pre-assembly to be carried out so that the final assembly requires only little effort. At the same time, the integration of the technology required for the illuminating unit is substantially accommodated in the illumination head of the telescopic sight as usual, wherein a flat design is possible. In contrast with previously known solutions however, the control electronics is accommodated in a removable housing in the form of an illuminating module, thus enabling relatively easy access thereto. At the same time, the illuminating module is screwed out or in by rotating the wall, which is securely retained with respect to the telescopic sight in a direction parallel to the axis of rotation. This ensures a secure retention of the illuminating module on the telescopic sight, wherein at the same time the illuminating module is protected by the wall of the saddle.

As a result of the embodiment according to the invention, the user can individually adjust the illuminating device of the graticule without changing the board and without having to remove the telescopic sight. The assembly and subsequent re-zeroing of the weapon, which are associated with a considerable amount of effort, are therefore also no longer required. The marksman is therefore able to individually adjust the illuminating unit to the best possible illumination range for his eye and to the application. It is not necessary to dismantle the illuminating unit for programming. Rather, the illuminating module is simply unscrewed from the saddle and inserted into the programming adapter for individual programming, for example of the illumination level. The illumination level and also other parameters can be individually adjusted and stored in the control electronics by means of a software package. After subsequently replacing the illuminating module in the saddle of the telescopic sight, the illuminating device is immediately ready for use once more without having to carry out further calibrations.

All in all, this provides a simple way of individualizing the illuminating device for an illuminated graticule in a telescopic sight of a firearm.

LIST OF REFERENCES

1 Telescopic sight
2 Telescope body
3 Eyepiece
4 Objective
5 Vertical adjustment
6 Horizontal adjustment
7 Illuminating module
Saddle
9 Outer face side
10 Housing
11 External thread
12 Collar
13 Inner face side
14 Cutout
15 Wall
16 Mounting space
17 Internal thread
18 Bottom
19 Contact elements
20 Fixing screw
21 Sealing element
22 Control electronics
23 Battery
24 Battery cage
25 Contact surface
26 Underside
27 Plug-in connector element
28, 29 Connecting geometry
30 Programming adapter
31 Base
32 Mounting
33 Wall
34 Internal thread
35 Contact elements
36 Interface

The invention claimed is:

1. A telescopic sight for a firearm which has a telescope body (2) with an eyepiece (3) and an objective (4) and an illuminating device for an illuminated graticule, wherein the illuminating device has a control electronics unit (22) and an energy store (23), characterized in that the control electronics unit (22) is arranged in a housing (10) which can be releasably accommodated in a saddle (8) on an outside of the telescopic sight (1).

2. The telescopic sight as claimed in claim 1, characterized in that the housing (10) has electronic contact surfaces, wherein corresponding contact elements (19) are arranged in the saddle (8).

3. The telescopic sight as claimed in claim 1, characterized in that the housing (10) is screwed to the saddle (8), wherein in particular the housing (10) has an external thread (11) and the saddle (8) an internal thread (17).

4. The telescopic sight as claimed in claim 1, characterized in that the housing (10) is in the form of a circular cylinder and has an inner face side (13) and an outer face side (9), wherein the electronic contact surfaces are arranged on the inner face side (13).

5. The telescopic sight as claimed in claim 3, characterized in that the saddle (8) has a sleeve-shaped wall (15) which is rotatably and axially immovably mounted on the telescopic sight (1), wherein the internal thread (17) is arranged in the wall (15), and the housing (10), at least for the most part, can be screwed into the wall (15).

6. The telescopic sight as claimed in claim 1, characterized in that the housing (10) is guided in a fixed rotational relationship with respect to the telescopic sight (1).

7. The telescopic sight as claimed in claim 1, characterized in that the energy store (23) is in the form of a battery which is arranged in a battery cage (24) of the housing (10), which in particular is accessible from the inner face side (13).

8. The telescopic sight as claimed in claim 1, characterized in that the housing (10) can be connected to the saddle (8) in a watertight and dust-tight manner, wherein in particular at least one sealing element (21) is arranged between housing (10) and saddle (8).

9. An illuminating module for a telescopic sight as claimed in claim 1, characterized in that it has a housing (10) in which a programmable control electronics unit (22) for an illuminating device of the telescopic sight is arranged.

10. The illuminating module as claimed in claim 9, characterized in that the housing (10) is in the form of a circular cylinder and in particular has electrical contact surfaces on an inner face side (13).

11. The illuminating module as claimed in claim 9, characterized in that the housing (10) has an external thread (11).

12. The illuminating module as claimed in claim 9, characterized in that the housing (10) encompasses a battery cage (24) for an electrical energy store (23) which in particular is accessible from the inner face side (13) of the housing (10).

13. The illuminating module as claimed in claim 9, characterized in that the control electronics (22) are arranged on at least one board which in particular rests against the outer face side (9) on the inside.

14. A programming adapter for an illuminating module as claimed in claim 9, characterized in that it has an interface (36) for a computer and a base (31) with a mounting (32) for the illuminating module (7), wherein the mounting (32) has contact elements (35), particularly on the bottom thereof, for producing a data-transmitting connection to the illuminating module.

15. The programming adapter as claimed in claim 14, characterized in that the mounting (32) has a sleeve-shaped wall (33) in which the illuminating module can be accommodated.

16. The programming adapter as claimed in claim 15, characterized in that the sleeve-shaped wall (33) has an internal thread (34) and is rotatably mounted with respect to the base (31) of the programming adapter (30), wherein the contact elements (35) are arranged on the base (30), and the illuminating module (7) can be accommodated in the mounting (32) in a fixed rotational relationship with respect to the base (31).

* * * * *